US006806690B2

(12) United States Patent
Xi

(10) Patent No.: US 6,806,690 B2
(45) Date of Patent: Oct. 19, 2004

(54) ULTRA-LOW QUIESCENT CURRENT LOW DROPOUT (LDO) VOLTAGE REGULATOR WITH DYNAMIC BIAS AND BANDWIDTH

(75) Inventor: Xiaoyu Xi, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 27 days.

(21) Appl. No.: 10/395,967

(22) Filed: Mar. 25, 2003

(65) Prior Publication Data

US 2003/0178976 A1 Sep. 25, 2003

Related U.S. Application Data

(63) Continuation-in-part of application No. 10/024,397, filed on Dec. 18, 2001, now Pat. No. 6,677,735.

(51) Int. Cl.[7] ..... G05F 1/40
(52) U.S. Cl. ..... 323/273; 323/280
(58) Field of Search ..... 323/272, 273, 323/266, 313, 312, 303, 280, 281, 269, 274

(56) References Cited

U.S. PATENT DOCUMENTS

| | | | | |
|---|---|---|---|---|
| 5,412,309 A | * | 5/1995 | Ueunten | 323/316 |
| 6,040,736 A | * | 3/2000 | Milanesi et al. | 327/541 |
| 6,188,212 B1 | * | 2/2001 | Larson et al. | 323/281 |
| 6,198,266 B1 | * | 3/2001 | Mercer | 323/316 |
| 6,246,221 B1 | | 6/2001 | Xi | |
| 6,304,131 B1 | * | 10/2001 | Huggins et al. | 327/538 |
| 6,518,737 B1 | * | 2/2003 | Stanescu et al. | 323/280 |

* cited by examiner

*Primary Examiner*—Rajnikant B Patel
(74) *Attorney, Agent, or Firm*—William B. Kempler; W. James Brady, III; Frederick J. Telecky, Jr.

(57) ABSTRACT

An LDO regulator automatically switches from the SLEEP mode to the ON mode without the need for an externally generated control signal. The LDO regulator utilizes a pair of drive amplifiers to drive a SLEEP mode pass transistor and a normal ON mode pass transistor, respectively. The regulator also has a circuit for adjusting the bias applied to the amplifiers for each mode of operation.

20 Claims, 6 Drawing Sheets

200
LOAD
298
VOUT
260
292
294
R_ESR
C_FILT
254
PSW_BIG
258
256
PSW_SML
252
286
288
290
R1
R2
250
248
G_PSW2
242
PSENSE
246
266
244
232
OPTIONAL
234
BUF
240
282
236
238
284
THRESHOLD
DETECTION AND BIAS
CURRENT ADJUST
296
VDD
G_PSW1
EN_HPM
230
280
DRV
279
228
A_big
278
276
A_sml
216
224
226
VFB
268
202
218
220
222
DelIV
VBIAS
CC
262
264
MASTER BIAS
ADJUST
N_CC
210
272
EN_HPM
204
A1
212
274
270
214
206
VREF
208

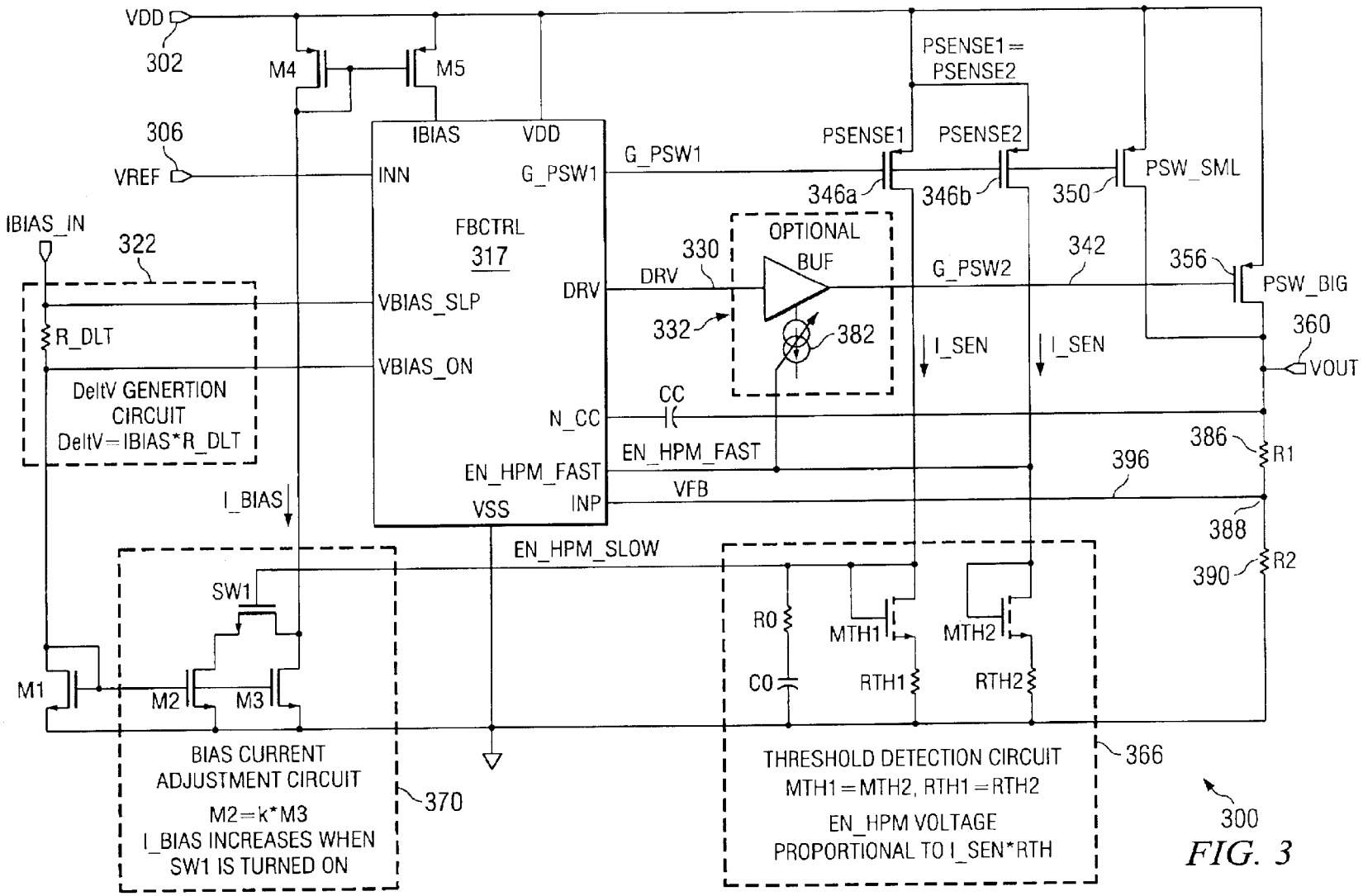
PSW_BIG
360
VOUT
R1
R2
386
388
390
300
FIG. 3
PSW_SML
356
396
366
350
342
I_SEN
PSENSE1 = PSENSE2
PSENSE2
346b
G_PSW2
I_SEN
MTH2
RTH2
PSENSE1
346a
OPTIONAL
BUF
382
MTH1
RTH1
R0
C0
THRESHOLD DETECTION CIRCUIT
MTH1 = MTH2, RTH1 = RTH2
EN_HPM VOLTAGE
PROPORTIONAL TO I_SEN*RTH
330
332
DRV
CC
EN_HPM_FAST
VFB
G_PSW1
VDD
G_PSW1
DRV
N_CC
EN_HPM_FAST
INP
EN_HPM_SLOW
FBCTRL
317
VSS
M5
IBIAS
INN
VBIAS_SLP
VBIAS_ON
370
M4
I_BIAS
SW1
M3
M2
BIAS CURRENT
ADJUSTMENT CIRCUIT
M2 = k*M3
I_BIAS INCREASES WHEN
SW1 IS TURNED ON
VDD
302
306
VREF
322
R_DLT
DelIV GENERTION
CIRCUIT
DelIV = IBIAS*R_DLT
IBIAS_IN
M1

317
402
VDD
416
G_PSW1
VBIAS_SLP
A_sml
428
VBIAS_ON
DRV
A_big
404
N_CC
INP
INN
A1
N_CC
IB_A1
IB_Abig
IB_Asml
EN_HPM_FAST
SW2
IBIAS
M12
M15
M13
M14
M11
VSS DC
RESPONSE
QUIESCENT CURRENT
(INCLUDING 1uA INPUT BIAS):
(I)
45uA
4.5uA
10^-2
10^-3
10^-4
10^-5
10^-6
100n
1u
10u
100u
1m
10m
100m
LOAD CURRENT

TRANSIENT
RESPONSE 2.920
2.885
2.850
2.815
2.780
◆ /LV_VOUT_HIESR
■ /HV_VOUT_LOESR
LV=Vin=3.2V, 1μF OUTPUT CAP, 300m ohm ESR
HV=Vin=4.2V, 1μF OUTPUT CAP, 20m ohm ESR
LOAD TRANSIENT 10uA TO 100mA IN 1us
29.960000m
30.006667m
30.053333m
30.100000m

ULTRA-LOW QUIESCENT CURRENT LOW DROPOUT (LDO) VOLTAGE REGULATOR WITH DYNAMIC BIAS AND BANDWIDTH

REFERENCE TO RELATED APPLICATIONS

This application is a continuation-in-part application of copending U.S. application Ser. No. 10/024,397 filed on Dec. 18, 2001 now U.S. Pat. No. 6,677,735, which is incorporated herein by reference.

FIELD OF THE INVENTION

The present invention relates generally to voltage regulation, and more particularly to a low drop-out (LDO) voltage regulator with a split power device.

BACKGROUND OF THE INVENTION

A low drop-out (LDO) regulator is a linear regulator which utilizes a transistor or FET to generate a regulated output voltage with very low differential between the input voltage and the output voltage. LDOs are often used in battery powered devices. In such applications, in order to minimize the current drain under light loads, it is common to have an "SLEEP" mode for the regulator in which the maximum load current is limited to a few milliamps and the quiescent current is very low, approximately 10–20 microamps. In the normal or "ON" mode, the normal load current can be a few hundred milliamps which requires a regulator having a higher bias current, as much as 100 microamps.

FIG. 1 illustrates FIG. 2 of the parent application. The application simplifies the construction of the regulator by utilizing a split output of the driver so that a relatively small power transistor is utilized in the low power or SLEEP mode and a larger device or both devices are used in the normal ON mode. FIG. 1 shows the LDO shown in FIG. 2 of the copending application generally as 100. An error amplifier 104 has its inverting input 106 coupled to a reference source VREF and its non-inverting input 108 coupled to a sample of the output voltage at node 188 via voltage divider 186, 190 and fed back via line 196. The output of the error amplifier 104 is fed into a second amplifier 111, the output of which is input to the non-inverting input of unity gain buffer amplifier 118. The output of this amplifier is split so that OUTPUT_2 on line 120 is coupled to the gate of large transistor 156 and the output 1 on line 122 is coupled to the gate of the small transistor 150. OUTPUT_1 is also coupled to the inverting input of amplifier 118. PMOS transistors 150 and 156 each have a source coupled to VDD at line 102 and a drain coupled to the output voltage at node 160. A Miller capacitor 162 is coupled from the output node 160 to the input 110 of the amplifier 111 via line 114. A resistor 192 in series with filter capacitor 194 is placed in parallel with load 198 between the output voltage at 160 and ground. A switch 123 is coupled between VDD and the gate of transistor 156. A switch 124 is coupled between the transistor 156 and the gate of transistor 150. The operation of the switch is determined where the circuit operates in the SLEEP mode or the normal ON mode. The switches are controlled via an external signal (not shown), although the specification discloses that it is possible to detect the load current level and have the LDO automatically switch modes.

SUMMARY OF THE INVENTION

It is a general object of the present invention to provide an LDO that switches automatically from SLEEP to ON modes.

This and other objects and features are attained, in accordance with one aspect of the invention, by a low drop-out voltage regulator, comprising an input error amplifier stage. A first amplifier stage has a first output, a first input coupled to an output of the input error amplifier stage and a second input coupled to a first bias source. A second amplifier stage has a second output, a third input coupled to the output of the input error stage and a fourth input coupled to a second bias source. A first power transistor has a gate coupled to the first output, the first power transistor also being coupled to a node where voltage is to be regulated. A second power transistor has a gate coupled to the second output, the second power transistor also being coupled to the node; wherein an output voltage of the first bias voltage source differs from an output voltage of the second bias voltage source by a predetermined voltage, whereby the first amplifier stage and the first power transistor are active at a first output current range and both the first amplifier stage and first power transistor and second amplifier stage and second power transistor are active at an output current that exceeds the first output current range.

A second aspect of the invention includes a low drop-out voltage regulator comprising an input error amplifier stage. A first amplifier stage has a first output, a first input coupled to an output of the input error amplifier stage. A second amplifier stage has a second output, a third input coupled to the output of the input error stage, wherein the input error amplifier stage, the first and second amplifier stages each have a bias input coupled to a threshold detection circuit. A first power transistor has a gate coupled to the first output, the first power transistor also being coupled to a node where voltage is to be regulated. A second power transistor has a gate coupled to the second output, the second power transistor also being coupled to the node wherein the threshold detection circuit determines if output current of the regulator exceeds a second output current range and adjusts a bias input to at least one of the input error amplifier stages, the first amplifier stage and the second amplifier stage when the output current exceeds the second output current.

A third aspect of the invention comprises a low drop out regulator comprising a first power transistor having a gate and being coupled to a node where voltage is to be regulated. A first drive stage receives a feedback signal from the node and is coupled to the gate of the first power transistor for regulating the voltage at the node when output current of the regulator is below a predetermined level. A second power transistor has a gate and is coupled to the node. A second drive stage receives the feedback signal and is coupled to the gate of the second power transistor for regulating the voltage at the node when output current of the regulator exceeds the predetermined level, wherein the second drive stage and the second power transistor are active only when the output current exceeds the predetermined level, the second drive stage being activated to drive the second power transistor by the feedback signal only, without a control signal generated external to the regulator.

A fourth aspect of the invention is provided by a low drop-out regulator comprising a first current path between an input voltage and a regulated output voltage at an output node. A second current path between an input voltage and the regulated output voltage at the node, wherein the first current path is active in a low current mode in which output current is below a predetermined level and at least the second current path is active in a high current mode in which the output current exceeds the predetermined level, the regulator switching from the low current mode to the high current mode without a control signal generated external to the regulator.

BRIEF DESCRIPTION OF THE DRAWINGS

FIG. 3 is a schematic drawing of the circuit of FIG. 2;

DETAILED DESCRIPTION OF THE PRESENT INVENTION

Figure 1:
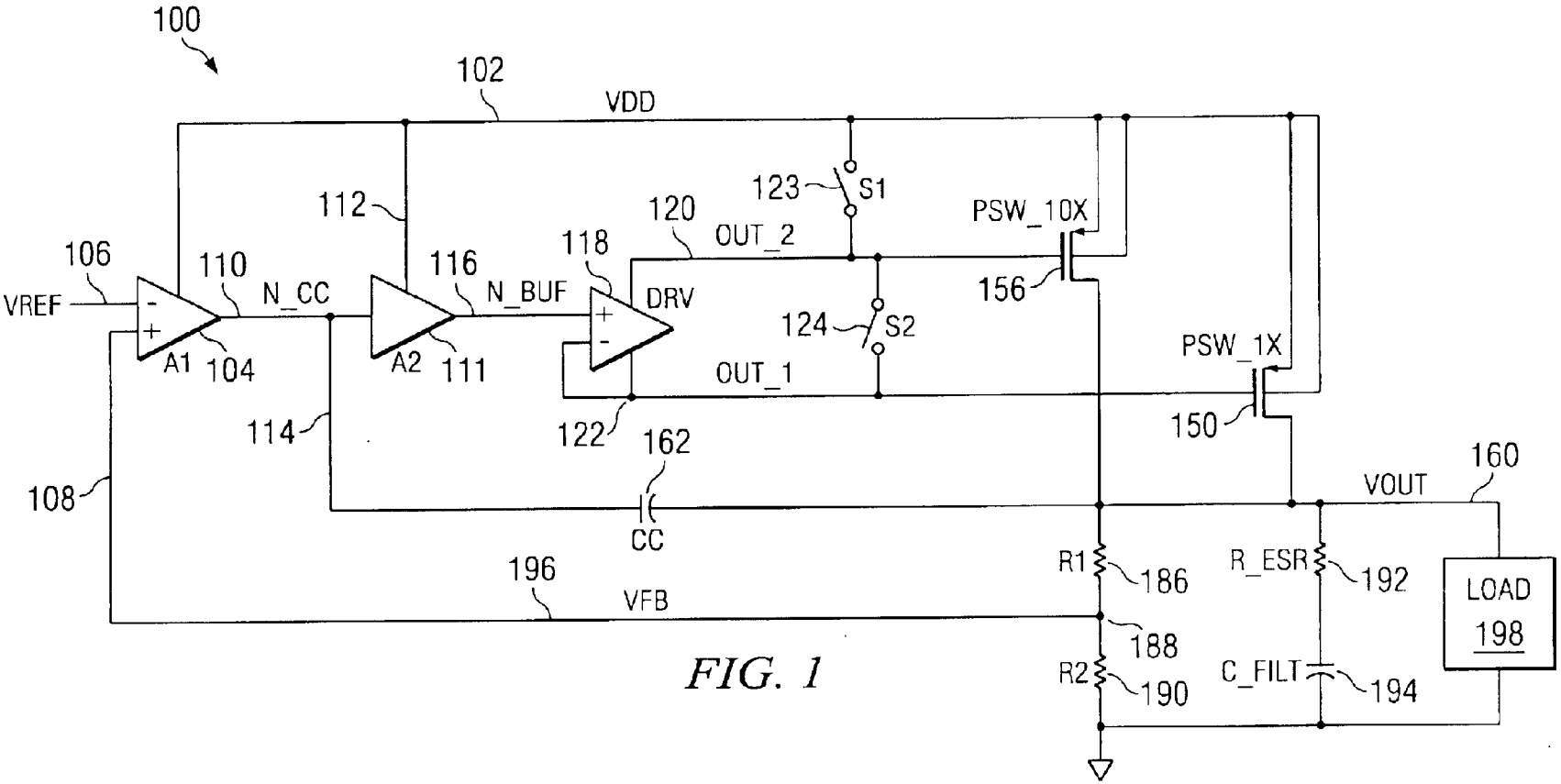
FIG. 1 illustrates FIG. 2 of copending application Ser. No. 10/024,397.
Figure 2:
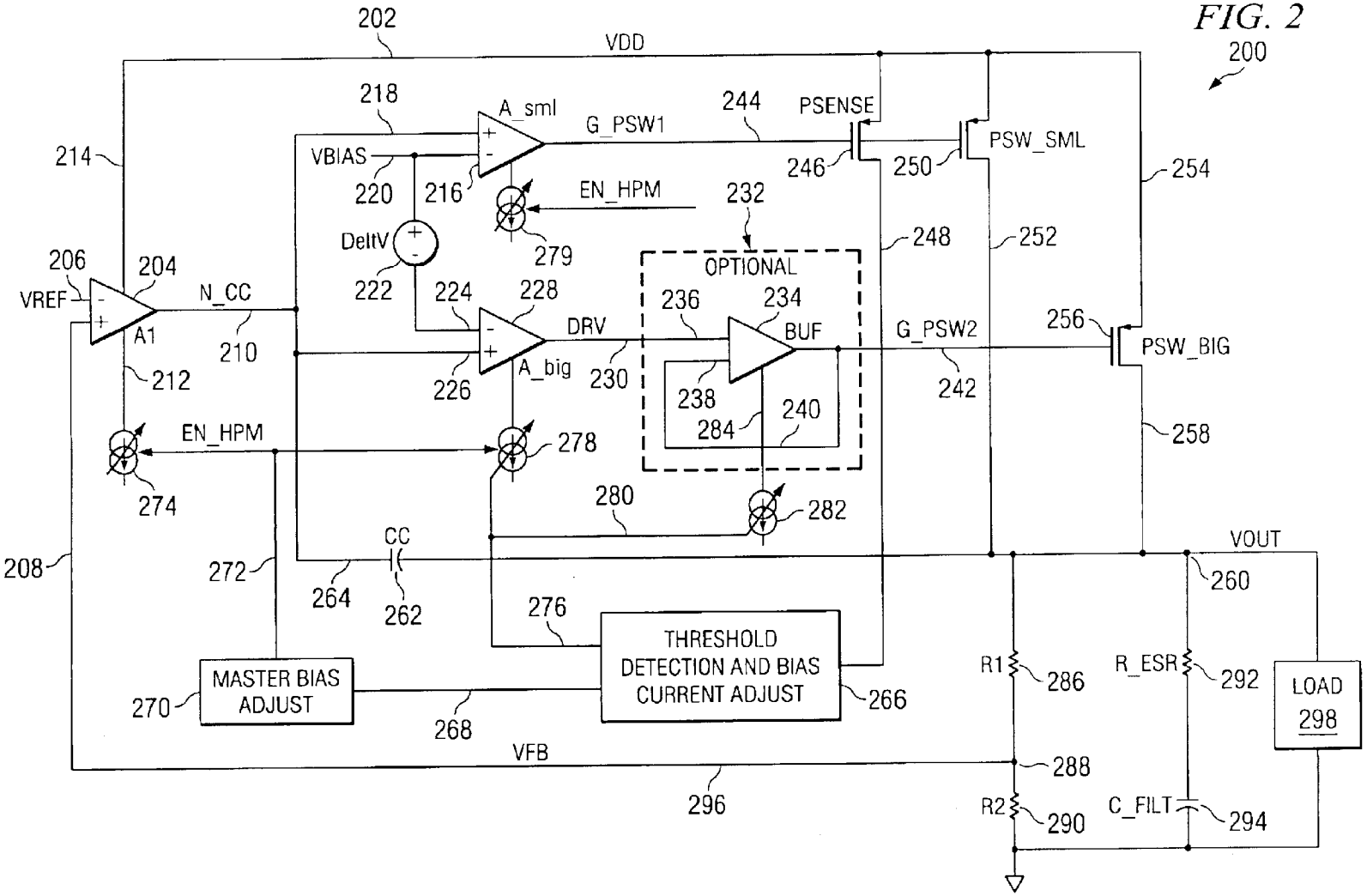
FIG. 2 is a schematic diagram of the present invention, partially in block form.

An embodiment of the present invention is shown in FIG. 2 generally as 200. In FIG. 2, error amplifier 204 has its non-inverting input 206 coupled to a reference source VREF. The non-inverting input 208 of amplifier 204 is coupled via line 296 to a node 288 which takes a sample of the output voltage via resistor divider 286, 290. The output of amplifier 204 on line 210 is coupled to the non-inverting input 218, 226 of amplifiers 216 and 228, respectively. The inverting input 220 of amplifier 216 is coupled to a bias source VBIAS and the inverting input 224 of amplifier 228 is coupled to the source VBIAS through the circuit 222 which introduces a difference voltage DELTV between the voltage on input 220 and the voltage on input 224. As shown in FIG. 2, the bias voltage applied to input 224 is lower than the bias voltage on line 220 via DELTV. The output of amplifier 216 on line 244 is applied to the gates of PMOS transistors 246 and 250. Both transistors have their sources coupled to line 202 and the voltage source VDD. Transistor 250 has its drain coupled via line 252 to the output of voltage node 260 and transistor 246 has its drain coupled via line 248 to the threshold detection and bias current adjustment circuit 266. PMOS power transistor 256 may be driven by a buffer amplifier 234, which is optional, if very low impedance is desired at node 242. In this case the output of amplifier 228 on line 230 is input to the non-inverting input 236 of buffer amplifier 234. The output of buffer amplifier 234 on line 242 is coupled to the gate of the PMOS power transistor 256. The output of amplifier 234 is fed back via line 240 to the inverting input 238 in order to provide a unity gain amplifier. The load 298 is coupled between the node 260 and ground. In parallel with the load is a resistor 292 and a filter capacitor 294.

The threshold detection and bias current adjustment circuit 266 generates a fast bias adjustment signal on line 276 which is coupled to an adjustable bias current source 278 for amplifier 228 via line 276 and to a similar circuit 282 for buffer amplifier 234, if used, via line 280. A slow bias adjustment signal is generated on line 268 which controls a master bias adjustment circuit 270 which provides a signal on line 272 to the adjustable current sources 274, 278 and 279. The operation of the threshold detection and biased current adjustment circuit 266 of the master bias adjustment 270 is explained in greater detail in connection with FIG. 3. A Miller capacitor 262 is coupled from node 260 to the non-inverting input 226 of amplifier 228 and 218 of amplifier 216. Amplifier 204 is coupled to the voltage source VDD on line 202 by line 214.

In operation, a reference source is coupled to the inverting input 206 of amplifier 204 which is compared to a fraction of the output voltage measured by resistors R1 and R2 and coupled to the non-inverting input 208 of amplifier 204. The error voltage output on line 210 is coupled to the non-inventing inputs of amplifiers 216 and 228. Amplifier 216 compares to this error voltage against a bias voltage VBIAS on line 220 to the inverting input of amplifier 216, to generate a signal on line 244 which controls small PMOS power transistor 250 to generate a regulated voltage at node 260. When the current is at a low enough value for transistor 250 to provide the regulated voltage, amplifier 228 is over driven because of the application of the bias voltage on line 224 which is lower than the bias voltage on line 220 by the voltage DeltV generated by circuit 222. Accordingly, the gate of PMOS transistor 256 is driven to the rail voltage (VDD) and transistor 256 is turned off. As the current through transistor 250 increases, the gate voltage drive will increasingly move down towards ground to turn the transistor 250 fully on. As the output voltage drops in value due to the increase in load, the voltage on line 210 and thus at inputs 218 and 226 will likewise drop. Once the input voltage has dropped by an amount of the voltage DeltV, amplifier 228 will start decreasing voltage on line 230 to drive the voltage on the gate of PMOS transistor 256 away from the voltage on line 202 in order to turn on transistor 256 to regulate the output voltage at node 260. This occurs without the need for a separate external signal telling the regulator to switch from the SLEEP mode in which only transistor 250 is operable to the normal operation mode in which both transistors 250 and 256 are operable to regulate the load current. In a typical example, the voltage generated by circuit 222 would be 75 millivolts. The high gain of the input error amplifier, typically around 50 dB, results in an output voltage that is lower only by less than a millivolt. The use of optional buffer amplifier 234 does not effect the operation of the regulator. The threshold detection and bias current adjustment circuit 266 provides a slow adjustment to the bias level of the three amplifiers 204, 216 and 228 so that they will have a higher bandwidth and a faster slew rate in order to respond to the larger load quickly. In addition, a fast boost is provided on line 276 to amplifier 228 and optional buffer amplifier 234, if utilized, to help the regulator respond quickly to the transition from a low load current to a high load current without destabilizing the control loop.

Referring now to FIG. 3, a more detailed construction of the circuit in FIG. 2 is shown generally as 300. In order to simplify the explanation of the circuit in FIG. 3, the amplifiers 204, 216, and 228 and related bias circuitry are shown as a single block 317. The connections of these amplifiers and the associated bias circuits are shown in detail in FIG. 4. A bias current IBIAS_IN flows through resistor R_DLT and through diode-connected transistor M1 to ground. The voltage across resistor R_DLT provides the voltage differential DeltV generated by circuit 222 in FIG. 2. The current through diode-connected transistor M1 is mirrored in transistor M3 and the current IBIAS_IN flows through diode connected transistor M4 and is mirrored by transistor M5 to generate the current IBIAS input to block 317. The slow bias adjustment signal on line 268, shown as EN_HPM_SLOW in FIG. 3 turns on switch SW1 to couple transistor M2 in parallel with transistor M3, to increase the bias current applied to block 317. Accordingly, transistors M2, M3 and SW1 comprise the master bias adjustment circuit 270 in FIG. 2, labeled 370 in FIG. 3. As is well known to those skilled in the art, the current through the transistors M2 and M3 are a function of the size of the transistors. Thus, for example, the current through transistor M3 might be 0.16 microamps and the current through transistor M2 may be 1 microamp.

In the circuit shown in FIG. 3, there are two current sensing transistors 246 (in FIG. 2), here labeled as 346*a* and 346*b*. These transistors have their gate connected to the gate of transistor 350. There are sized such that they sample a small portion of the current flowing through the transistor 350, for example, 1% of the current through transistor 350. In the circuit of FIG. 3, block 366 corresponds to block 266 in FIG. 2. The current flowing through transistor 346*b* flows through diode-connected transistor MTH2 and resistor RTH2 to ground. The voltage generated across this transistor and the resistor becomes the signal EN_HPM_FAST which corresponds to the signal on line 276 in FIG. 2. The current flowing through transistor 346*a* flows through diode-connected transistor MTH1 and resistor RTH1 to ground. A resistor R0 and series connected capacitor C0 is connected across the diode connected transistor MPH1 and resistor RTH1 to ground. The voltage generated across the diode-connected transistor and resistor is slowed by the time constant of the resistor R0 and capacitor C0 to generated the signal EN_HPM_SLOW which is input to the gate of transistor SW1 in block 370 and corresponds to the signal 268 in FIG. 2. The optional buffer circuit 332 is connected between the output 330 of block 317 and the line 342 which is coupled to the gate of large power PMOS transistor 356. Its variable bias current source 382 is connected to signal EN-HPM_FAST and functions similar to the circuit for the block 317 illustrated in FIG. 4. The feedback capacitor CC is connected between the output at node 360 and the input N_CC. The feedback circuit comprises resistor divider 386, 390 provide a voltage at node 388 to the terminal INP at block 317. The reference voltage VREF is applied to the terminal 306 and connected to the terminal INN of block 317. Block 317 is also connected to the power supply voltage VDD and ground.

Figure 4:
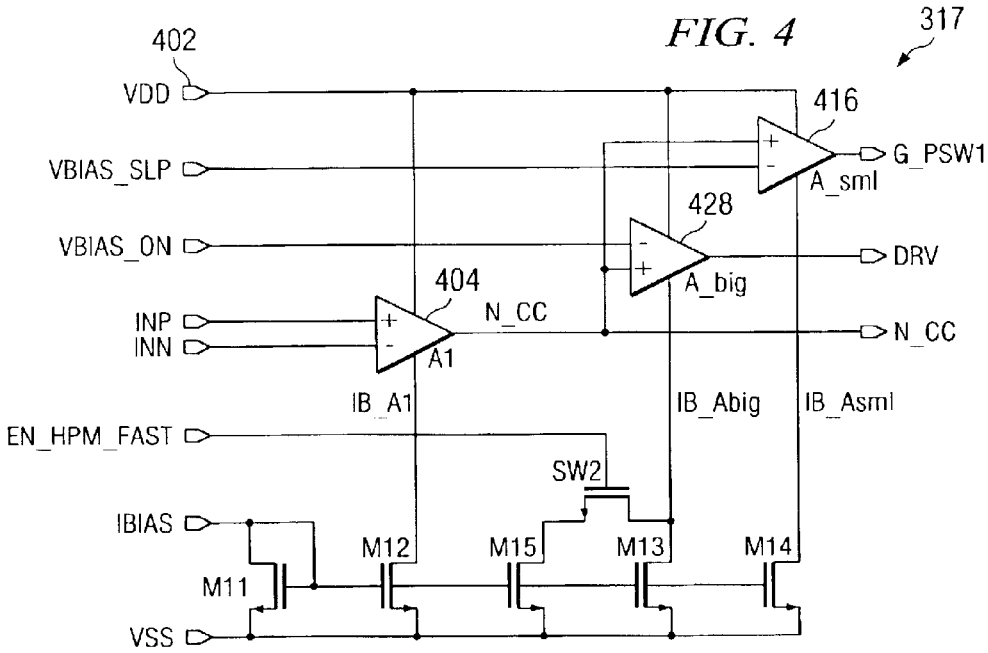
FIG. 4 is a block diagram of block 317 of FIG. 3.

The connections of the amplifiers and bias circuit in block 317 of FIG. 3 are shown in detail in FIG. 4. Thus, in FIG. 4, the input voltage VDD is applied to terminal 402 and thus to the amplifiers 404, 416 and 428, which correspond to the amplifiers 204, 216 and 228 in FIG. 2, respectively. Amplifier 416 is supplied with a first bias signal VBIAS_SLP and amplifier 428 is supplied with a lower bias voltage VBIAS_ON. These two signals are generated in block 322 of FIG. 3. The feedback voltages applied to the non-inventing input of amplifier 404 via the terminal INP and the reference voltage VREF is applied to the terminal INN of amplifier 404. Each of the three amplifiers 404, 416 and 428 are supplied with a bias current which is proportional to the current IBIAS input to block 317 in FIG. 3. This current flowing through diode-connected transistor M11 is mirrored by transistors M12, M13 and M14 to supply bias current to amplifiers 404, 428 and 416, respectively. The signal EN_HPM_FAST which correspond to the signal on line 276 of FIG. 2 is applied to the switching transistor SW2. This transistor, when activated, connects transistor M15 in parallel with transistor M13 to increase the current to the large current drive amplifier 428. Transistor M15 can be sized to increase the bias current to the amplifier 428 by a factor of 4, for example. The output of amplifier 416 on terminal G_PSW1 as applied to the gate of transistor 350 and the output signal DRV is applied to the gate of transistor 356 to provide the regulated output both in the SLEEP and ON modes. The feedback capacitor is connected to terminal N_CC.

Accordingly, the present invention provides both a mechanism to switch from the SLEEP mode to the ON mode without the need for an externally generated control signal, and a method for increasing the bias current to the drive amplifiers for both the SLEEP mode pass transistor and ON mode pass transistor. The use of two separate amplifiers for driving the pass transistors one of which is offset from the bias of the other, provides a smooth transition from one mode to the other without the need to measure the current through the load and, thus avoids stability problems which may result from such a circuit arrangement. The bias currents to the amplifiers are controlled in order that a larger bias be provided to the drive amplifier driving the larger pass transistor (amplifier 228, 428) in order that it respond quickly to the increase in output current and a further delayed increase in the bias current to improve the bandwidth and slew rate of the amplifiers to respond to the large load quickly. The circuit construction utilized to adjust the bias levels avoids the necessity of additional gain stages that would be required if the circuit were used to switch between the SLEEP and ON modes, and thus avoids the stability issue.

Figure 5:
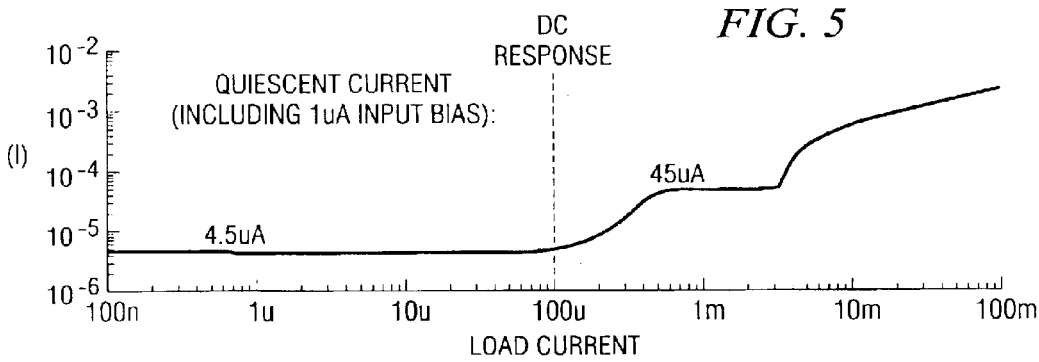
FIG. 5 is a graph of the quiescent current of the regulator with varying load currents.
Figure 6A:
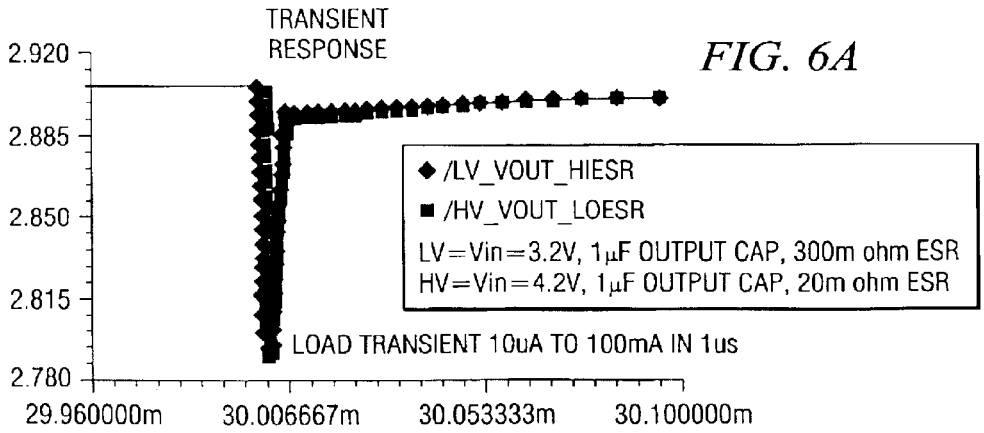
FIGS. 6A–6D are graphs showing the transient response of the regulator to changing load currents.
Figure 6B:
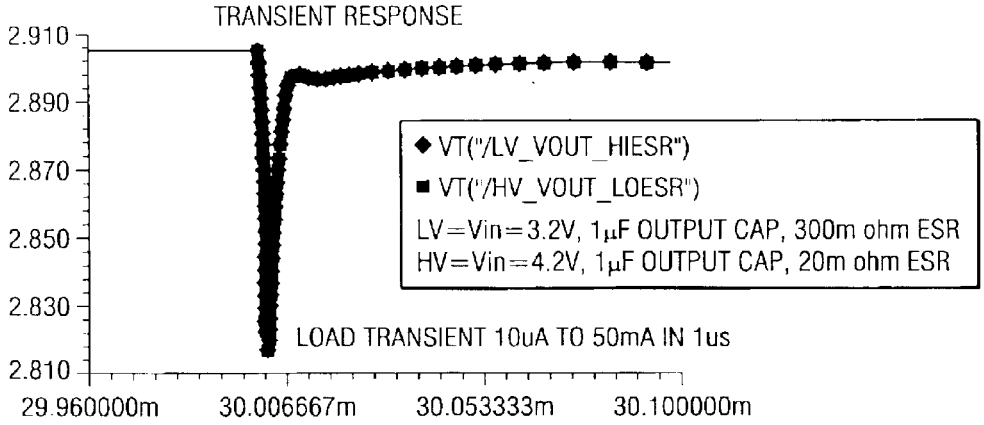
Figure 6C:
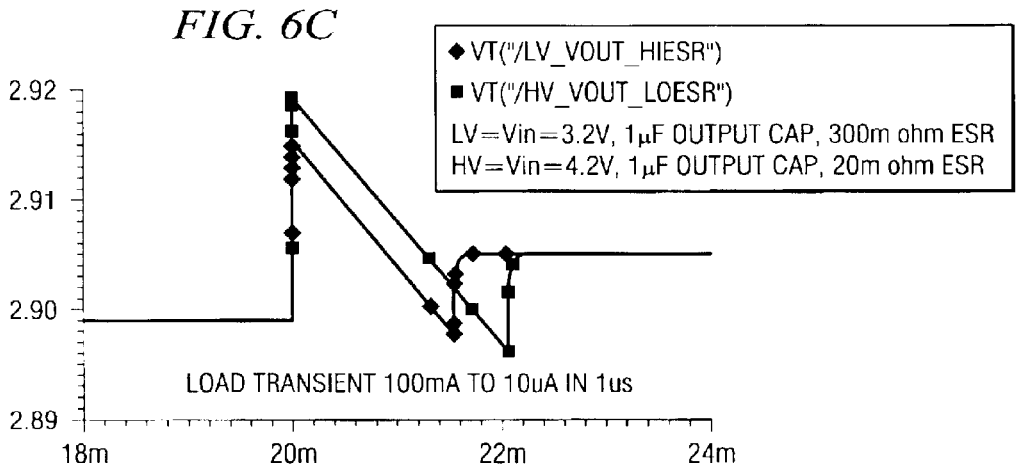
Figure 6D:
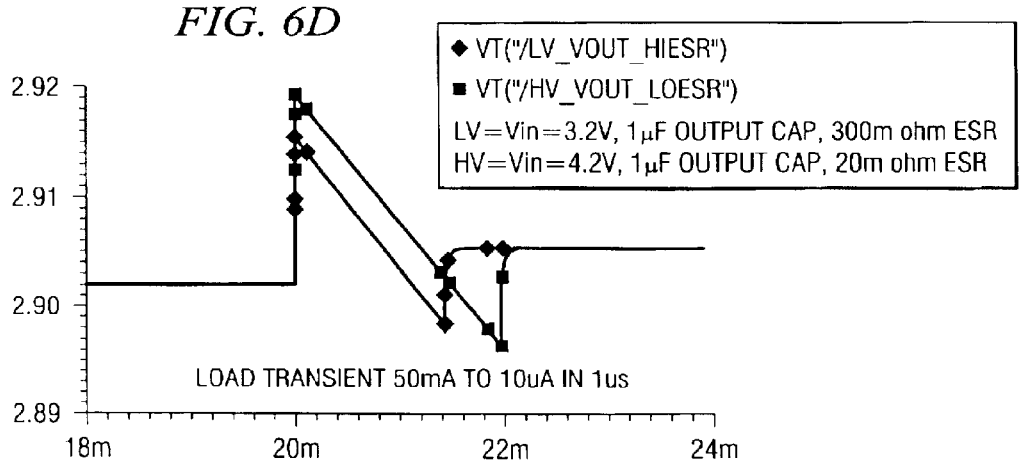

FIG. 5 is a graph showing the variation of quiescent current as a function of the load current for a typical LDO according this invention. FIGS. 6A–6D illustrate the transient response of a typical LDO according to this invention. In FIG. 6A, the load transient for change in load current from 10 microamps to 100 milliamps in one microsecond is shown. There are two curves here, one for input voltage of 3.2 volts with a 300 milliohm ESR (equivalent series resistance) and the other for the input voltage of 4.2 volts with a 20 milliohm ESR. However, in FIG. 6A, and also in FIG. 6B, these curves overlap, so that the two curves are not distinguishable. In FIG. 6B, the load transient changes from 10 microamps to 50 milliamps in one microsecond. In FIG. 6C, the load transient changes from 100 milliamps to 10 microamps in one microsecond. In this case, as well as in the case of FIG. 6D, the two curves separate during the transient and are distinguishable. In FIG. 6D, the load transient changes from 50 milliamps to 10 microamps in one microsecond.

Figure 7A:
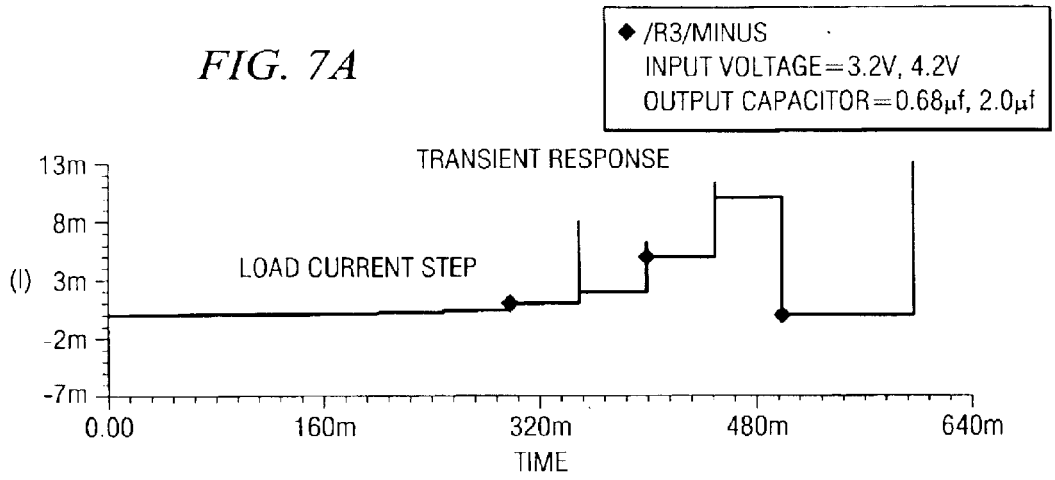
FIG. 7A is a graph of a load current step increment.
Figure 7B:
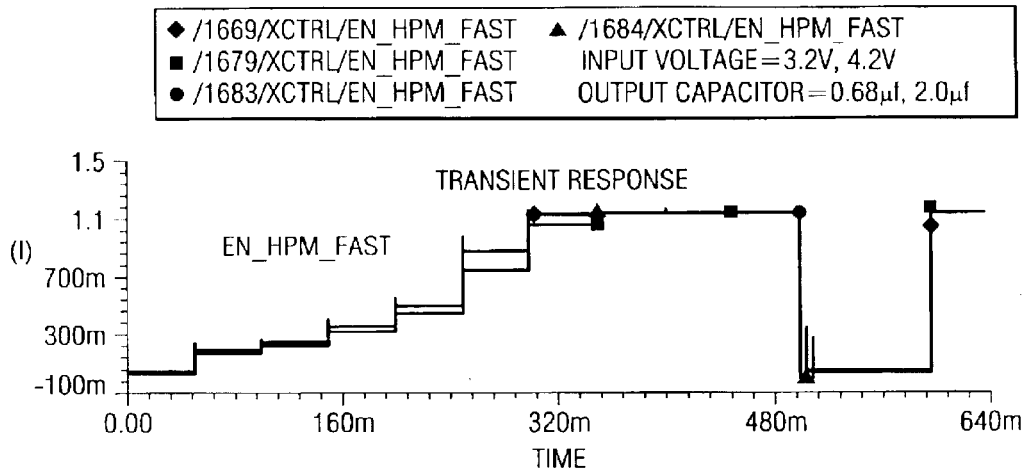
FIGS. 7B and 7C are graphs of the internal generated control signals which gradually switch the LDO from low power SLEEP mode to normal ON mode in response to the load current level of FIG. 7A.
Figure 7C:
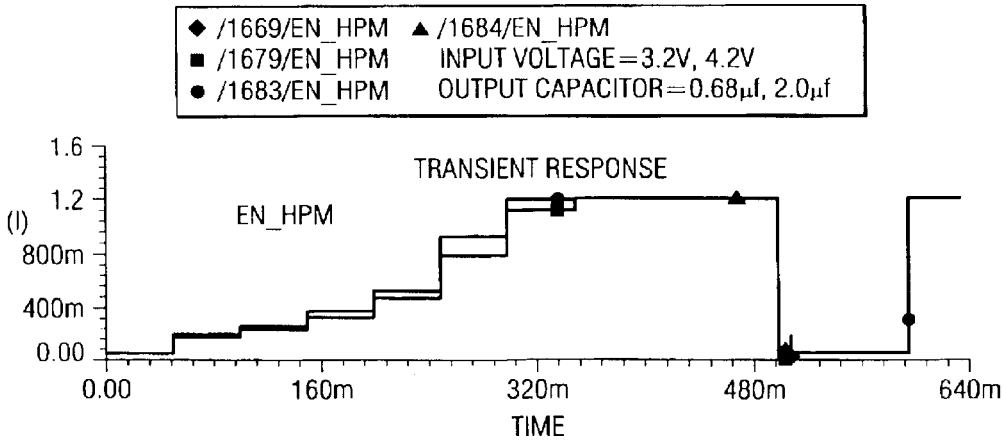

FIG. 7A illustrates a load current step increment from minimum to medium level, which is ~10 milliamps in this example. FIG. 7B illustrates the change of the signal EN_HPM_FAST resulting from the load current step in FIG. 7A. FIG. 7C illustrates the change in the signal EN_HPM as a result of the load current step of FIG. 7A. The curves in 7B and 7C demonstrate that the transition from SLEEP mode to ON mode is a continuous but stable process, with no indication of oscillation in any way. Avoiding oscillation during transition is one of the most challenging and critical requirements in dynamically biased LDO applications. In both FIGS. 7B and 7C the input voltage is 3.2 volts or 4.2 volts and the output capacitor is 0.6 microfarads or 2 microfarads, resulting in 4 possible combinations.

While the invention has been shown and described with reference to preferred embodiments thereof, it is well understood by those skilled in the art that various changes and modifications can be made in the invention without departing from the spirit and scope of the invention as defined by the appended claims:

What is claimed is:

1. A low drop-out voltage regulator, comprising:

an input error amplifier stage;

a first amplifier stage having a first output, a first input coupled to the output of the input error amplifier stage and a second input coupled to a first bias source;

a second amplifier stage having a second output, a third input coupled to the output of the input error stage and a fourth input coupled to a second bias source;

a first power transistor having a gate coupled to the first output, the first power transistor also being coupled to a node where voltage is to be regulated;

a second power transistor having a gate coupled to the second output, the second power transistor also being coupled to the node; wherein an output voltage of the first bias voltage source differs from an output voltage of the second bias voltage source by a predetermined voltage, whereby the first amplifier stage and the first power transistor are active at a first output current range and both the first amplifier stage and first power transistor and second amplifier stage and second power transistor are active at an output current that exceeds the first output current range.

2. The low drop-out voltage regulator of claim 1 wherein the second power transistor is larger than the first power transistor.

3. The low drop-out voltage regulator of claim 2 wherein the second power transistor is approximately ten times as large as the first power transistor.

4. The low drop-out voltage regulator of claim 1 wherein the first power transistor is a PMOS transistor having a drain coupled to said node and a source coupled to a supply voltage.

5. The low drop-out voltage regulator of claim 4 wherein the second power transistor is a PMOS transistor having a drain coupled to said node and a source coupled to a supply voltage.

6. The low drop-out voltage regulator of claim 1 including a further unity-gain buffer amplifier stage connected between the output of the second amplifier stage and the gate of the second power transistor.

7. A low drop-out voltage regulator, comprising:

an input error amplifier stage;

a first amplifier stage having a first output, a first input coupled to the output of the input error amplifier stage;

a second amplifier stage having a second output, a third input coupled to the output of the input error stage, wherein the input error amplifier stage, the first and second amplifier stages each have a bias input coupled to a threshold detection circuit;

a first power transistor having a gate coupled to the first output, the first power transistor also being coupled to a node where voltage is to be regulated;

a second power transistor having a gate coupled to the second output, the second power transistor also being coupled to the node; wherein the threshold detection circuit determines if output current of the regulator exceeds a second output current and adjusts a bias input to at least one of the input error amplifier stages, the first amplifier stage and the second amplifier stage when the output current exceeds the second output current.

8. The low drop-out regulator of claim 7 further comprising a further buffer stage connected between the output of the second amplifier stage and the gate of the second power transistor, the further buffer stage having a bias input coupled to the threshold detection circuit.

9. The low drop-out regulator of claim 7 further comprising a sensing transistor in parallel to the first transistor for sensing a portion of the current through the first transistor.

10. The low drop-out regulator of claim 7 further comprising a master bias current circuit coupled to an output of the threshold detection circuit and having an output coupled to the input error amplifier stage, and the first and second amplifier stages.

11. The low drop-out regulator of claim 8 further comprising a master bias current circuit coupled to an output of the threshold detection circuit and having an output coupled to the input error amplifier stage, and the first and second amplifier stages and the further buffer stage.

12. The low drop-out regulator of claim 7 further comprising a fast bias generator circuit coupled to the threshold detection circuit and having an output coupled to a bias input to the second amplifier stage.

13. The low drop-out regulator of claim 8 further comprising a fast bias generator circuit coupled to the threshold detection circuit and having an output coupled to a bias input to the second amplifier stage and the further buffer stage.

14. The low drop-out voltage regulator of claim 7 wherein the second power transistor is larger than the first power transistor.

15. The low drop-out voltage regulator of claim 14 wherein the second power transistor is approximately ten times as large as the first power transistor.

16. The low drop-out voltage regulator of claim 7 wherein the first power transistor is a PMOS transistor having a drain coupled to said node and a source coupled to a supply voltage.

17. The low drop-out voltage regulator of claim 16 wherein the second power transistor is a PMOS transistor having a drain coupled to said node and a source coupled to a supply voltage.

18. The low drop-out regulator of claim 7 wherein the first amplifier has a second input coupled to a first bias source, the second amplifier has a fourth input coupled to a second bias source and wherein an output voltage of the first bias voltage source differs from an output voltage of the second bias voltage source by a predetermined voltage, whereby the first amplifier stage and the first power transistor are active at a first output current range and both the first amplifier stage and first power transistor and second amplifier stage and second power transistor are active at an output current that exceeds the first output current range.

19. A low drop out regulator comprising:

a first power transistor having a gate and being coupled to a node where voltage is to be regulated;

a first drive stage receiving a feedback signal from the node and being coupled to the gate of the first power transistor for regulating the voltage at the node when output current of the regulator is below a predetermined level;

a second power transistor having a gate and being coupled to the node;

a second drive stage receiving the feedback signal and being coupled to the gate of the second power transistor for regulating the voltage at the node when output current of the regulator exceeds the predetermined level, wherein the second drive stage and the second power transistor are active only when the output current exceeds the predetermined level, the second drive stage being activated to drive the second power transistor by the feedback signal only, without a control signal generated external to the regulator.

20. A low drop-out regulator comprising:

a first current path between an input voltage and a regulated output voltage at an output node;

a second current path between an input voltage and the regulated output voltage at the node, wherein the first current path is active in a low current mode in which output current is below a predetermined level and at least the second current path is active in a high current mode in which the output current exceeds the predetermined level, the regulator switching from the low current mode to the high current mode without a control signal generated external to the regulator.

* * * * *